US006945173B2

(12) United States Patent
Donges et al.

(10) Patent No.: US 6,945,173 B2
(45) Date of Patent: Sep. 20, 2005

(54) METHOD FOR AUTOMATICALLY EXCHANGING A PRINTING PLATE AS WELL AS CORRESPONDING ROTARY PRESS

(75) Inventors: Markus Donges, Mannheim (DE); Holger Faulhammer, Stuttgart (DE); Bernhard Wagensommer, Malsch (DE)

(73) Assignee: Heidelberger Druckmascinen AG, Heidelberg (DE)

( * ) Notice: Subject to any disclaimer, the term of this patent is extended or adjusted under 35 U.S.C. 154(b) by 0 days.

(21) Appl. No.: 10/294,953

(22) Filed: Nov. 14, 2002

(65) Prior Publication Data

US 2003/0094111 A1 May 22, 2003

(30) Foreign Application Priority Data

Nov. 16, 2001 (DE) ..... 101 56 378

(51) Int. Cl.[7] ..... B41F 33/00
(52) U.S. Cl. ..... 101/484; 101/477
(58) Field of Search ..... 101/477, 247, 101/415.1, 483, 484

(56) References Cited

U.S. PATENT DOCUMENTS 3,719,142 A * 3/1973 Abe ..... 101/216
4,036,135 A 7/1977 Raible et al. ..... 101/463
4,858,528 A * 8/1989 Inouye et al. ..... 101/175
5,555,812 A 9/1996 Ruckmann et al. ..... 101/477
6,125,757 A 10/2000 Lemelin ..... 101/477

FOREIGN PATENT DOCUMENTS

| | | |
|---|---|---|
| DE | 2446608 | 4/1976 |
| DE | 3614554 | 11/1987 |
| DE | 4331430 | 3/1994 |
| DE | 19834783 | 2/2000 |
| DE | 19942617 | 4/2000 |
| DE | 19941634 | 3/2001 |
| JP | 6114557 | 6/1986 |

OTHER PUBLICATIONS

Helmut Kipphan: Handbook of Print Media, pp. 321 to 321; Springer Verlag, 2000.

* cited by examiner

*Primary Examiner*—Leslie J. Evanisko
(74) *Attorney, Agent, or Firm*—Davidson, Davidson & Kappel, LLC

(57) ABSTRACT

A method for automatically exchanging a printing plate (500) in a print unit of a rotary press having a blanket cylinder (250) and a plate cylinder (260) carrying the printing plate includes disengaging the plate cylinder from the blanket cylinder; reducing the speed of the plate cylinder (v_P) to a rendezvous speed (v_R) which is greater than 0; automatically clamping the printing plate onto the plate cylinder at the rendezvous speed (v_R); and increasing the speed of the plate cylinder (v_P) to a printing speed (v_DG).

13 Claims, 3 Drawing Sheets

METHOD FOR AUTOMATICALLY EXCHANGING A PRINTING PLATE AS WELL AS CORRESPONDING ROTARY PRESS

Priority to German Patent Application No. 101 56 378.7, filed Nov. 16, 2001 and hereby incorporated by reference herein, is claimed.

BACKGROUND OF THE INVENTION

The present invention is directed to a method for automatically exchanging a printing plate in a print unit of a rotary press having a blanket cylinder and a plate cylinder carrying the printing plate, as well as to a rotary press with a plate cylinder and a blanket cylinder.

German Patent Application No. DE 199 42 617 describes such a method and such a machine, the printing plate being brought into contact with a nip roller in order to perform a plate replacement. The nip roller applies pressure to the printing plate, pressing it toward the plate cylinder during the plate replacement. In this manner, the gap between the blanket cylinder and the plate cylinder can be kept very small when a plate replacement is performed "on the fly". To perform a plate replacement, the plate cylinder in question is disengaged from the associated blanket cylinder and its rotation is stopped.

The previously existing design for automatically clamping a plate provides for the printing press to be at a standstill when the plate is inserted. On the one hand, this stoppage constitutes a delay in the execution of the automatic plate exchange; on the other hand, following the stoppage, a build-up time is again needed to start the machine. This contradicts the philosophy of a plate exchange operation that does not necessitate an operator.

A printing plate exchange without the intervention of an operator is also known, a cassette-type system being used to automate the process of removing and bringing in the plate (H. Kipphahn: Handbook of Print Media, pp. 321 to 323; Springer Verlag, 2000).

In the context of printing presses, it is also generally known to perform an angular synchronization from print unit to print unit with respect to the main and follower drives.

BRIEF SUMMARY OF THE INVENTION

An object of the present invention is to devise a method of automatic plate exchange and a corresponding rotary press which will improve the automatic plate exchange process.

The present invention provides a method for automatically exchanging a printing plate (500) in a print unit of a rotary press having a blanket cylinder (250) and a plate cylinder (260) carrying the printing plate, characterized by the following method steps: disengaging the plate cylinder from the blanket cylinder; reducing the speed of the plate cylinder (v_P) to a rendezvous speed (v_R) which is greater than 0; automatically clamping the printing plate to the plate cylinder at the rendezvous speed (v_R); and increasing the speed of the plate cylinder (v_P) to a printing speed (v_DG).

A rotary press for printing on a material web, having a print unit including a blanket cylinder (250) and a plate cylinder (260), carrying a printing plate (500), including a plate-conveyor unit (410) which transports the printing plate to the plate cylinder, wherein a control device (600) is provided, which, for the automatic plate exchange, adjusts the positions and speeds of the printing plate (500) and of the plate cylinder (260) to one another, whereby, given a plate cylinder speed greater than 0, the plate-conveyor unit (410) brings the printing plate into a clamping device (420) of the plate cylinder or moves it away from the same.

The printing press even rotates during the process of clamping a plate, thus, it is not stopped. The entire process of automatically replacing a plate takes less time, and the need is eliminated for additional build-up phases.

A control device, position-sensing means, as well as drive means are advantageously provided to synchronize the movements of the plate cylinder and of the printing plate, in order to ensure a rapid, reliable and trouble-free clamping and unclamping of the printing plate.

To be able to ensure a reliable clamping of the printing plate regardless of insignificant positioning and speed errors, when initiating the rendezvous, the speed of the plate cylinder is lower for a short time than that of the printing plate. Therefore, for a brief duration, the printing plate moves at a faster rate than the plate cylinder, so that the printing plate is pressed for a short time against the clamping bar of the plate cylinder for the clamping procedure.

BRIEF DESCRIPTION OF THE DRAWINGS

On the basis of schematized representations, an exemplary embodiment of the rotary press according to the present invention, as well as the method according to the present invention are described in the following. The figures show.

DETAILED DESCRIPTION

Figure 1:
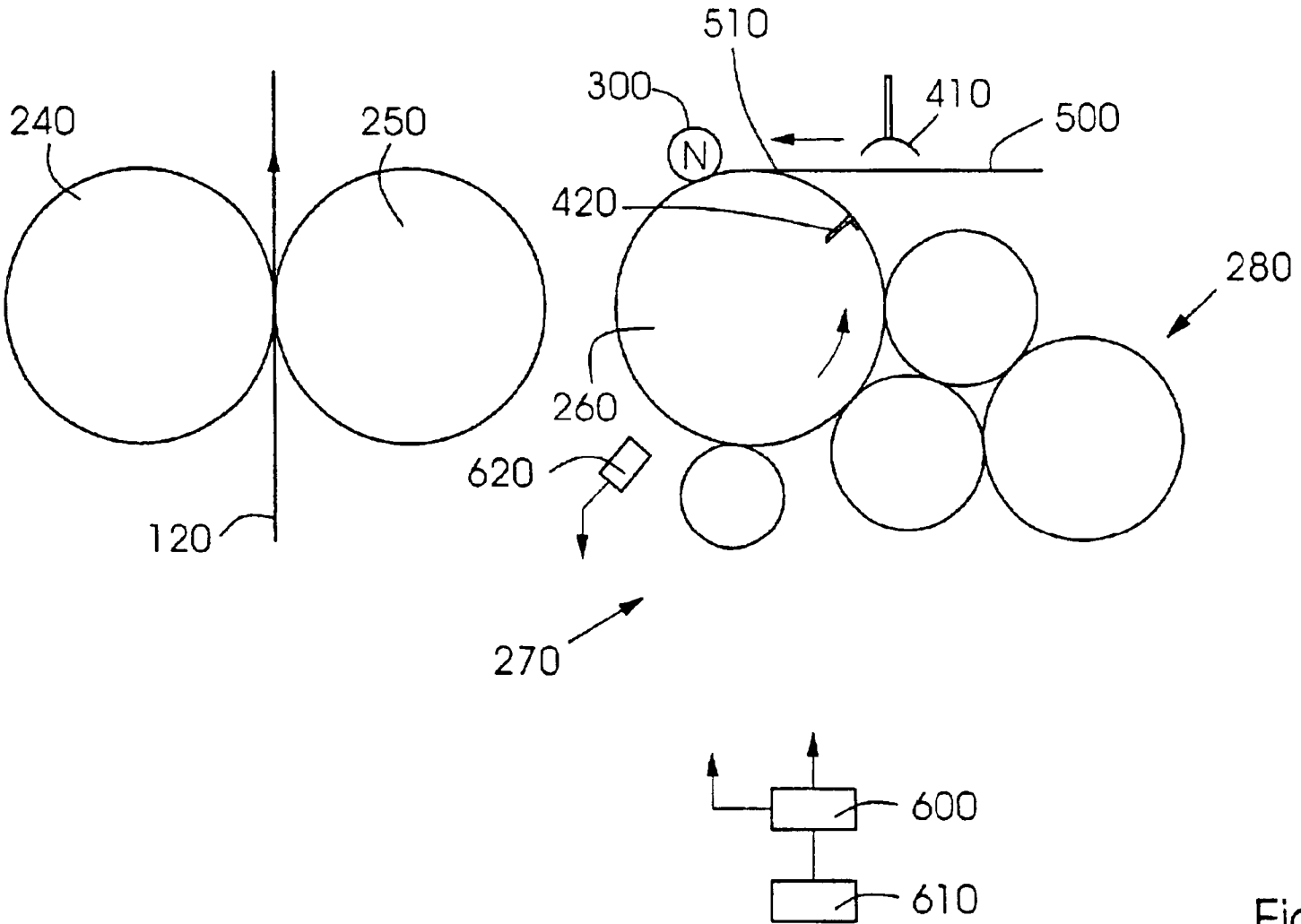
FIG. 1 a rotary press in a greatly simplified, cutaway view.

In accordance with FIG. 1, a web 120 to be printed on is fed between two blanket cylinders 240 and 250. For the sake of simplicity, merely the right print unit is shown and described in greater detail. Printing plates 500 containing the images to be printed are mountable on a plate cylinder 260 assigned to right blanket cylinder 250. In addition, a damping unit 270, as well as an inking unit 280 are assigned in a generally known manner to plate cylinder 260. FIG. 1 shows the positions of the plate cylinder and of the blanket cylinder during implementation of an automatic plate exchange. In this context, plate cylinder 260 is laterally disengaged from its associated blanket cylinder 250. Printing plate 500 to be clamped is moved by a plate-conveyor unit, shown here simply as a suction device 410, toward plate cylinder 260 (as shown by the arrow). However, to clamp and unclamp printing plate 500, cassette-type systems, known from the related art, may also be used for the automatic plate exchange. In this context, a nip roller 300 presses printing plate 500, bringing it into close proximity of plate cylinder 260. As a result, a minimal gap between blanket cylinder 250 and plate cylinder 260 suffices to implement the printing plate exchange. At least one clamping bar 420 is provided at the plate cylinder. During the clamping procedure, the clamping bar holds printing plate 500, conveyed to the plate cylinder, at its front plate edge 510, viewed in the moving direction (as shown the arrow). Printing plate 500 is subsequently pulled by the rotary motion of plate cylinder 260 out of the printing-plate cassette, for example, and clamped onto the plate cylinder. Upon reaching a trailing edge of printing plate 500, nip roller 300, for example, is briefly moved slightly away and is then forced into direct contact again, in order to press the trailing edge of the printing plate into a corresponding groove of plate cylinder 260.

The speed during clamping of printing plate 500 corresponds more or less to rendezvous speed v_R and amounts to about 60 to 100 impressions per hour. A rendezvous duration T_R, in which the speed of the plate cylinder's drive is more or less the same as that of the printing plate's drive, amounts to about 3 seconds. On the other hand, the time lag between the time plate edge 510 is introduced into clamping bar 420 and trailing edge of printing plate 500 into a corresponding holding device of the plate cylinder, amounts maximally to about one minute.

A control device 600 is provided to coordinate the movements and the speeds of plate cylinder 260 and of printing plate 500. In addition to a signal-processing unit 610, it includes, in particular, position-sensing means 620 and, in some instances, speed-sensing means. From the recorded data, unit 610 computes the corresponding control variables for the individual drive means of the print unit, the plate cylinder and, respectively, of plate-conveyor unit 410. In the context of the control, the printing-plate drive and the main drive, i.e., the drive for the plate cylinder, constitute a compound drive whose mechanisms may be used for purposes of synchronization. The speed profile is able to be adapted to the handling speed of the plate, i.e. to plate speed v_P. The printing press rotates during the entire automatic plate-exchange operation. This applies especially to the clamping and, analogously, to the unclamping of printing plate 500. During the actual clamping of the plate ("rendezvous"), the printing press fundamentally rotates at a speed—rendezvous speed v_R—that is reduced compared to a printing speed v_DG. A corresponding speed profile is taken as a basis for the clamping operation illustrated in FIG. 1. Thus, a synchronization is carried out between the drive for plate insertion and the main drive, i.e., the drive of plate cylinder 260. Functioning as a type of synchronization unit, control device 600 cooperates with the various detection means and the drives of the plate cylinder and of the plate-conveyor unit.

An open-loop control instead of the feedback control is also a cost-effective alternative for the entire functional sequence of the automatic plate exchange. However, it is less advantageous in terms of design safety. The open-loop control is implemented, for example, via a slip clutch. The termination or end condition is to be implemented in this context via a time-out mechanism, in order to avoid an endless loop in the event of a failed rendezvous; or it is implemented via the feedback "clamping is accomplished".

Figure 2:
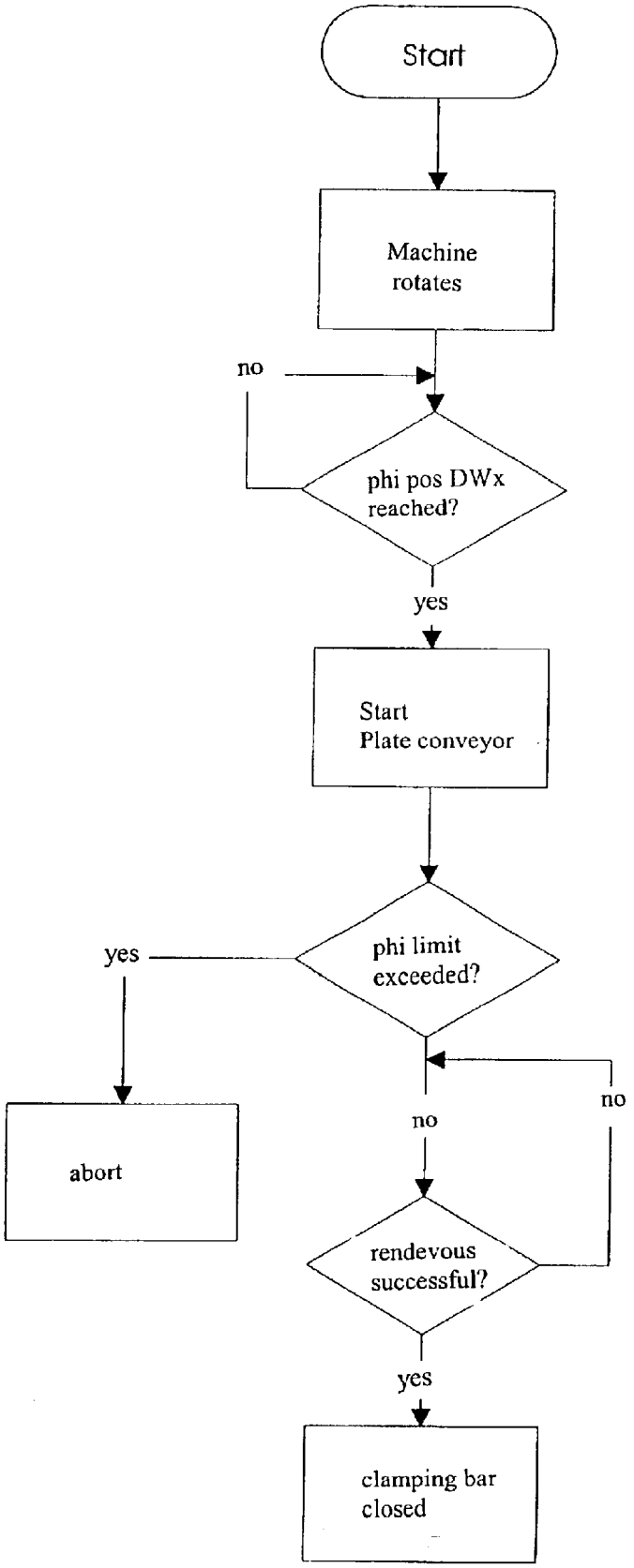
FIG. 2 a flow chart of the method according to the present invention for automatic plate exchange; as well as FIGS. 3*a,b* illustrative time diagrams of plate cylinder and printing plate speeds during implementation of the automatic plate exchange.

The flow chart for the automatic plate exchange of FIG. 2 is run through exactly once for each plate to be replaced. Here $\phi_{pos}$ (phi_pos) signifies the machine starting angle: the machine angle starting from which the drive is activated for the plate insertion. $\phi_{limit}$ (phi_limit) is the machine limiting angle: the machine angle at which the clamping bar is no longer able to be reached from the plate edge.

In this context, the following possible operating-time errors are to be recorded by control device 600 using appropriate detection means, i.e., the automatic plate exchange procedure is to be stopped, and an error signal to this effect is to be output:

No plate is inserted at a print unit where a printing plate needs to be exchanged.

A wrong plate is inserted at a print unit where a printing plate needs to be exchanged, or the plate is wrongly inserted.

The slip at the drive is too great.

In addition, when unclamping the printing plate, it is important that it be pulled out completely, so that the clamping of the new printing plate is not obstructed.

Figure 3A:
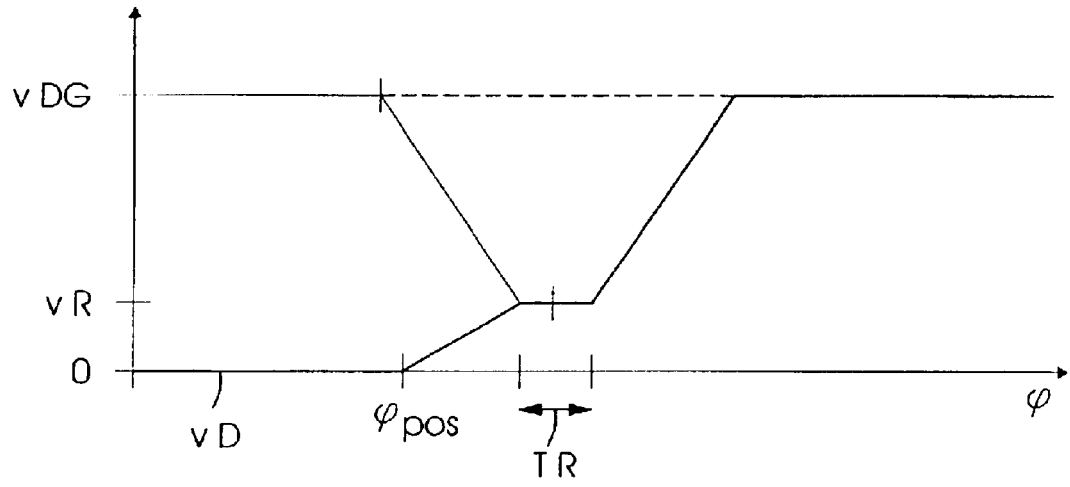

In accordance with FIGS. 3*a* and *b*, the following speed profiles are taken as a basis for the main drive. In accordance with FIG. 3*a*, plate cylinder 260 initially runs at speed v_P, which corresponds, for example to printing speed v_DG (typ. 3,000–15,000 impressions per hour). Starting at a specific point in time, the speed of plate cylinder v_P is linearly reduced, for example, to rendezvous speed v_R. Depending on the characteristic of plate-cylinder speed v_P, at the calculated point in time, i.e., at the machine starting angle $\phi_{pos}$, the drive is activated for the plate insertion. In the process, printing-plate speed v_D is raised from zero to approximately rendezvous speed v_R. For the rendezvous duration T_R, both drives, namely the drive for plate cylinder 260, as well as the drive for printing plate 500 run at the same rate of speed. The printing plate is then securely held at plate edge 510 by clamping bar 420 at plate cylinder 260. While the drive of the printing plate may be deactivated, the drive of the plate cylinder increases the speed of plate cylinder v_P and, thus, also the clamped printing plate again to printing speed v_DG. Since it holds at the point in time of the rendezvous that v_P=v_D, control device 600 must ensure that plate edge 510 meets with clamping bar 420 at precisely the correct instant and at the proper speed.

Figure 3B:
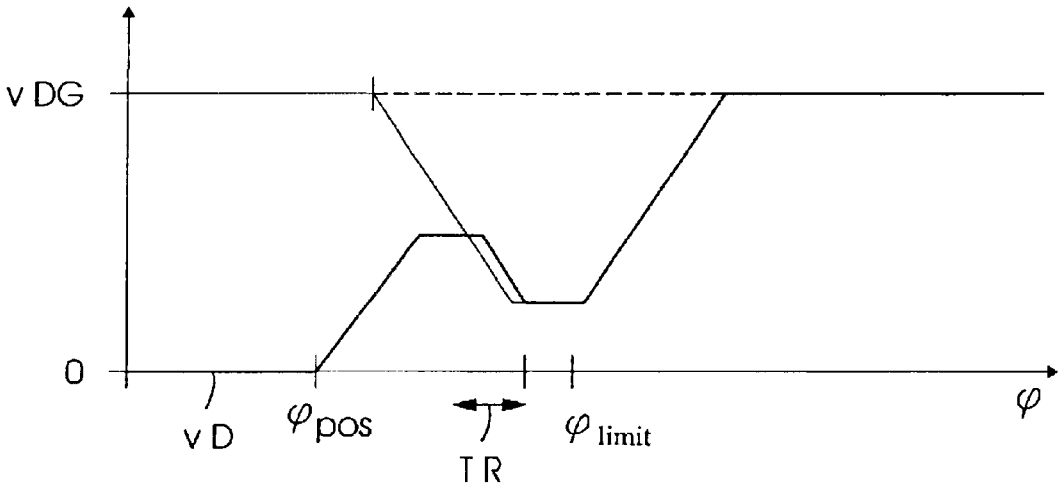

Deviating herefrom, in the context of the rendezvous according to FIG. 3*b*, printing plate 500 is brought to a speed that is greater than rendezvous speed v_R. In particular, the speed of printing plate v_D is also selected to be greater than the speed of plate cylinder v_P. Printing plate 500 is thereby reliably pressed for a brief period of time toward clamping bar 420 of plate cylinder 260 to effect the clamping. In this context, rendezvous speed v_R varies over time. Following the rendezvous, at rendezvous speed v_R, the drive of plate-conveyor unit 410 is switched off, and printing plate 500 is pulled by the rotary motion of plate cylinder 260 out of the cassette and clamped onto plate cylinder 260. The drive of the plate cylinder subsequently increases the speed of the plate cylinder again to printing speed v_D. In the event that, upon reaching machine limiting angle $\phi_{limit}$, control device 600 does not receive the confirmation from a suitable detection means that printing plate 500 is properly fixed to plate cylinder 260, the automatic plate exchange operation is stopped.

It is also possible that v_D<v_P is selected for the rendezvous, thus that printing plate 500 is not overtaken by plate cylinder 260.

The present invention is applicable to a wide variety of printing presses, such as to sheet-fed printing presses. The term rotary presses refers both to web presses as well as to sheet-fed printing presses.

Reference Symbol List

| | |
|---|---|
| 120 | web |
| 240, 250 | blanket cylinder |
| 260 | plate cylinder |
| 270 | damping unit |
| 280 | inking unit |
| 300 | nip roller |
| 410 | suction device |
| 420 | clamping bar |
| 500 | printing plate |
| 510 | plate edge |
| 600 | control device |
| 610 | signal-processing unit |
| 620 | position detector |
| T_R | rendezvous time |
| v_D | printing plate speed |
| v_DG | printing speed |
| v_P | plate cylinder speed |
| v_R | rendezvous speed |
| $\phi_{limit}$ | machine limiting angle |
| $\phi_{pos}$ | machine starting angle |

What is claimed is:

1. A method for automatically exchanging a printing plate in a print unit of a rotary press having a blanket cylinder and a plate cylinder carrying the printing plate, comprising the steps of:

disengaging the plate cylinder from the blanket cylinder;

reducing a speed of the plate cylinder from a printing speed to a rendezvous speed which is greater than 0;

automatically clamping a printing plate by moving the printing plate at a speed to the plate cylinder while the plate cylinder is rotating at the rendezvous speed;

increasing the speed of the plate cylinder to the printing speed;

the rotary press rotating between and during the reducing step and the automatically clamping step and thus not stopping.

2. The method as recited in claim 1 further comprising performing a further check test to verify whether the printing plate is inserted into the print unit and whether a proper printing plate is inserted into the print unit, and preventing a start of the automatic plate exchange and outputting of an error signal if the further check test fails.

3. The method as recited in claim 1 further comprising using a control device, a position-sensing device, and a drive to synchronize the speed of the plate cylinder and the speed of the printing plate.

4. The method as recited in claim 1 further comprising starting a plate-conveyor unit when the plate cylinder reaches a preset machine starting angle.

5. The method as recited in claim 1 wherein, upon reaching a preset machine limiting angle, a rendezvous of the printing plate with the plate cylinder is aborted when a clamping bar of the plate cylinder is not yet reached by the printing plate.

6. The method as recited in claim 1 wherein the rendezvous speed is 60 to 100 impressions/hour.

7. The method as recited in claim 1 wherein a time during which the speed of the plate cylinder is substantially equal to the speed of the printing plate is 3 seconds.

8. The method as recited in claim 1 wherein to initiate a rendezvous of the printing plate with the plate cylinder, the speed of the plate cylinder for a period of time prior to the rendezvous is less than the speed of the printing plate.

9. The method as recited in claim 1 further comprising unclamping the printing plate at a further rendezvous speed which is greater than 0.

10. The method as recited in claim 1 wherein the rotary press continues rotating during a whole printing plate exchanging procedure.

11. The method as recited in claim 1 wherein the reducing of the speed of the plate cylinder occurs in linear fashion using a drive for the plate cylinder.

12. The method as recited in claim 1 wherein a drive for the plate cylinder reduces the speed of the plate cylinder.

13. The method as recited in claim 1 further comprising controlling a drive for the plate cylinder to perform the reducing and increasing steps.

* * * * *

UNITED STATES PATENT AND TRADEMARK OFFICE

CERTIFICATE OF CORRECTION

PATENT NO. : 6,945,173 B2
DATED : September 20, 2005
INVENTOR(S) : Donges et al.

It is certified that error appears in the above-identified patent and that said Letters Patent is hereby corrected as shown below:

Title page,
Item [73], change to read:
-- [73] Assignee: Heidelberger Druckmaschinen AG, Heidelberg (DE) --.

Signed and Sealed this

Twentieth Day of December, 2005

JON W. DUDAS
*Director of the United States Patent and Trademark Office*